US005400941A

United States Patent [19]

Schmode et al.

[11] Patent Number: 5,400,941

[45] Date of Patent: Mar. 28, 1995

[54] CORE END SLEEVES WHICH ARE LINKED TO ONE ANOTHER IN THE FORM OF A BELT, AND DEVICE FOR THEIR TRANSPORTATION

[75] Inventors: Hartmut Schmode, Blomberg; Siegfried Storm, Schlangen; Helmut Thiele, Kamen; Ulrich Wiebe, Dörentrup; Bernd David; Detlev Hetland, both of Detmold; Hans-Joachim Kornfeld, Vlotho; Johann-Georg Salten, Lage/Hagen; Michael Schlue, Detmold, all of Germany

[73] Assignee: Weidmuller Interface GmbH & Co., Detmold, Germany

[21] Appl. No.: 971,469

[22] Filed: Nov. 4, 1992

[30] Foreign Application Priority Data

Nov. 4, 1991 [DE] Germany ..... 41 36 301.9

[51] Int. Cl.[6] ..... H01R 43/045

[52] U.S. Cl. ..... 226/127; 29/751; 72/410

[58] Field of Search ..... 226/127, 196; 72/410; 29/750, 758, 764, 751

[56] References Cited

U.S. PATENT DOCUMENTS 3,710,610 1/1973 McCaughey ..... 72/410

FOREIGN PATENT DOCUMENTS 327452 8/1989 European Pat. Off. .
2402187 5/1979 Germany .
4008515 1/1992 Germany .
4104736 8/1992 Germany .

*Primary Examiner*—Daniel P. Stodola

[57] ABSTRACT

Core end sleeves (22) are linked to one another in the form of a belt and in each case have a metal sleeve (70) in the front region and a plastic sleeve (71), which partially engages over the metal sleeve (70), in the rear region, via which the core end sleeves are connected to one another. The plastic sleeves are in each case provided on their rear end with a projection (72) which points to the rear and rests on an outer side of the belt. The height, running at right angles to the plane of the belt, of the projection (72) is independent of the diameter of the plastic sleeves (71). Core end sleeves (22) for different conductor cross-sections can thus be transported using one and the same core end sleeve guide track (63) which has a guide groove (67) on its one side wall (65) for the projections (72).

11 Claims, 2 Drawing Sheets

CORE END SLEEVES WHICH ARE LINKED TO ONE ANOTHER IN THE FORM OF A BELT, AND DEVICE FOR THEIR TRANSPORTATION

FIELD OF THE INVENTION

The invention relates to core end sleeves which are linked to one another in the form of a belt. A plastic sleeve covers a metal sleeve for each core sleeve and each plastic sleeve is provided on a rear end thereof with a rearwardly pointing projection device for transportation of these core end sleeves which are linked to one another in the form of a belt is also provided.

DESCRIPTION OF THE BACKGROUND ART

A crimping device has already been disclosed in EP-A1-0,327,452, by means of which core end sleeves which are initially linked to one another in the form of a belt can be crimped onto the stripped conductor ends. The core end sleeves in each case have a metal sleeve in the front region and a plastic sleeve, which partially engages over the metal sleeve and is permanently connected to it, in the rear region. In this case, the core end sleeves are connected to one another via the plastic sleeves.

The core end sleeves which are linked to one another in the form of a belt are guided in a groove-shaped core end sleeve guide track which has a base and mutually opposite side walls. The distance of the side walls from one another in this case corresponds to the length of the core end sleeves which are transported at right angles to their longitudinal direction. In general it is necessary to use core end sleeves of different thickness for conductors of different thickness, so that different and replaceable core end sleeve guide tracks are provided for the known crimping device. Each core end sleeve guide track is suitable for holding only one sort of core end sleeves so that the core end sleeve guide track must be changed whenever it is intended to use core end sleeves of different size.

SUMMARY OF THE INVENTION

The invention is based on the object of creating the core end sleeves which can be transported in one and the same core end sleeve guide track irrespective of the cross-sectional size of the conductor onto which they are intended to be crimped.

The aim of the invention is furthermore to construct the guide track of the core end sleeve transportation device such that this object is achieved.

According to the invention, the plastic sleeves of the core end sleeves are in each case provided on their rear end with a projection which points to the rear and rests on an outer side of the belt.

The core end sleeve guide track of the transportation device is constructed according to the invention such that one of the side walls has a guide groove which is incorporated in an extension of the base and is used to hold the projections of the core end sleeves in a fitting manner during their transportation along the guide track.

The core end sleeves which are linked to one another in the form of a belt are pushed into the core end sleeve guide track such that the respective projections come to rest on the base of the core end sleeve guide track. In this case, these projections project into the guide groove. The length of the core end sleeves, seen without the projection, is matched to the distance of the side walls of the guide track from one another, so that the core end sleeves can be transported along the guide track at right angles to their longitudinal direction and in the belt longitudinal direction, without excessive play in their longitudinal direction. In this case, the height of the guide groove at right angles to the base of the guide track is matched to the corresponding height of the projections, so that the core end sleeves are held at right angles to the base of the guide track, also virtually without any play.

For core end sleeves of different size, which can be crimped, for example, to conductor cross-sections of 0.5 $mm^2$, 0.75 $mm^2$, 1.0 $mm^2$, 1.5 $mm^2$ and 2.5 $mm^2$, the height of the respective projection running at right angles to the plane to the belt is independent of the diameter of the plastic sleeves, so that one and the same core end sleeve guide track can be used for transportation of core end sleeves of different size.

As already mentioned, the distance of the side walls of the guide track from one another is matched to the length of the core end sleeves, seen without the projection. Core end sleeves for different lead cross-sections thus have the same length.

However, they may also be of different length if only the plastic sleeves are the same length for all cross-sectional sizes. In this case, the core end sleeves can be locked in their longitudinal direction by means of a step which is present in the groove longitudinal direction of the guide track. The length of the plastic sleeves, seen without the projection, then corresponds to the distance between the step and that side wall in which the longitudinal groove is located. The metal sleeves then come to rest above the step. In this case, the metal sleeve of the core end sleeve for the smallest conductor cross-section may lie directly on the step, while the metal sleeves of core end sleeves for larger conductor cross-sections are located at a distance above the step.

According to one advantageous embodiment of the invention, the plastic sleeves may in each case have a perforating slot, which runs on its rear end and in the longitudinal direction of the belt, in order to form the projection. In this case, there are virtually two projections, the projection located further from the base of the guide track not being used, however, to guide the core end sleeves. The perforating slot has a greater or lesser width depending on the size or diameter of the plastic sleeves, so that the height, running at right angles to the plane of the belt, of the projections corresponds to the height of the guide groove in every case. As a result of the perforating slot, which runs symmetrically with respect to the plastic sleeves, the core end sleeve belt can be pushed into the guide track by means or-one or the other of its ends, which would not be possible with only one projection. The projections are injection-moulded at the same time as the production of the plastic sleeves.

In order to hold the projections of the core end sleeves inside the guide groove, there may also be elastic pressure elements on the side wall of the guide track opposite the guide groove, particularly in the end region of the guide track. In most cases, even more precise positioning of the core end sleeves is necessary, because they are transferred from the end of the guide track into the depression of a crimping device. The crimping device may, for example, be a crimping drum having different depressions for core end sleeves of different size. The elastic pressure element is particularly advantageous if the crimping drum moves in the axial direction once a depression has been loaded with a core end sleeve, said crimping drum being removed from the side wall having the guide groove and taking the core end sleeve belt with it. If the core end sleeve which is located in the depression is not separated from the belt until subsequently, to be precise by suitable rotation of the crimping drum, the displaced core end sleeve belt must be moved back into the original position again, which is done by the elastic pressure element. This pressure element presses the core end sleeves back against the side wall containing the guide groove and thus presses the projections into the guide groove again. In consequence, the core end sleeves are precisely positioned for the next loading process.

For even better positioning of the core end sleeves in the end region of the guide track, the base can be provided with a row of teeth at the end of the guide track. Said row of teeth is also used to lock the core end sleeves when a core end sleeve transportation device is removed from the crimping drum, as is still to be explained.

Furthermore, a blade may be located in the base region at the end of the guide track, which blade separates the core end sleeves from one another when the crimping drum rotates and, at the same time, the core end sleeve which is located in the depression is moved past the blade.

In order to load the depression with a core end sleeve, the already-mentioned transportation device for feeding the core end sleeves in a step-by-step manner is located above the guide track. This transportation device is preferably driven in synchronism with the crimping drum, or is controlled by its rotation. In consequence, the synchronisation process can be carried out particularly easily.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The invention is described in more detail in the following text, making reference to the drawings which are given by way of illustration only, and thus are not limitative of the present invention, and in which.

DESCRIPTION OF THE PREFERRED EMBODIMENTS

Figure 1:
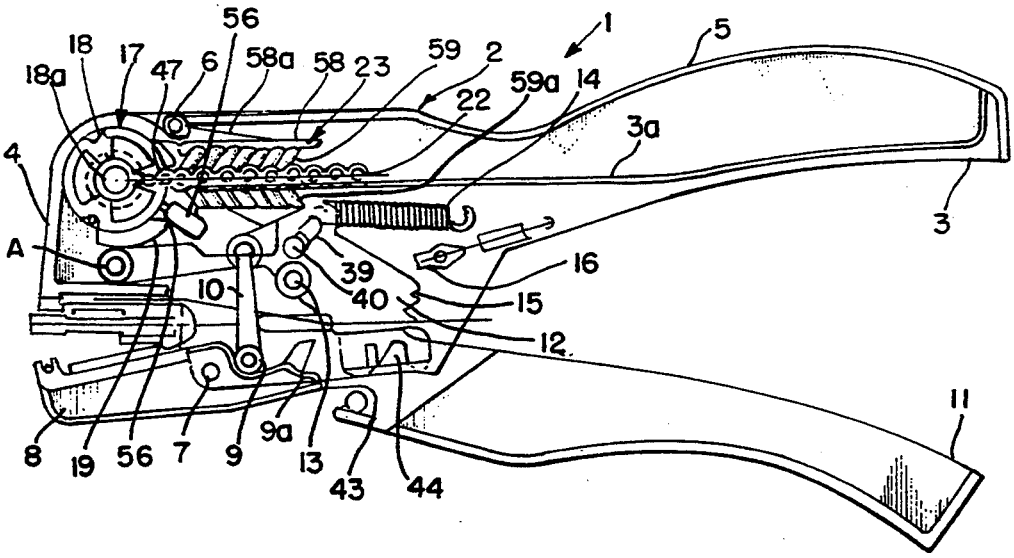
FIG. 1 shows combination tongs having a cutting station, stripping station and crimping station.

FIG. 1 shows tongs 1, or combination tongs, in which the transportation device according to the invention is located for the transportation of core end sleeves which are linked to one another in the form of a belt. In other words, the core end sleeves can be processed according to the invention using these tongs 1.

The tongs 1 consist of a tongs body 2 to which an upper handle 3, which is stationary relative to the tongs body 2, is integrally connected. The tongs body 2 and the upper handle 3 form a common cavity. A stationary clamping jaw 4 is fitted to the front lower end of the tongs body 2. The upper part of the upper handle 3 is constructed as a cover 5 which can rotate and is supported such that it can pivot about a shaft 6 which is attached to the tongs body 2. Located in the upper handle 3 is a base 3*a* which, together with the cover 5 and a part of the tongs body 2, forms a cavity for holding a supply of core end sleeves 22 which are linked to one another in the form of a belt.

Located on the lower part of the tongs body 2 are bearing pins 7 about which a moving clamping jaw 8 is supported such that it can pivot. This clamping jaw 8 has control surfaces 9, 9a which are aligned to the tongs body 2 and which are located on the side of the bearing pin 7 which points towards the handle end of the tongs 1. The moving clamping jaw 8 is rotated or driven around the bearing pin 7 via a jointed lever 10 which runs on the control surfaces 9, 9*a*.

A lower handle 11 of the tongs 1 is integrally connected to a drive part 12, which, for its part, is jointed to the tongs body 2, via the bearing pin 13, such that it can rotate. The jointed lever 10 is connected in a jointed manner to the drive part 12 at a point which is located at the front and in front of the bearing pin 13 with respect to the tongs 1. When the handles 3 and 11 are moved towards one another, then the jointed lever 10 runs off on the control surfaces 9 and 9*a* such that the clamping jaws 4 and 8 are initially closed and subsequently opened again when the jointed lever 10 acts on the control surface 9*a*. A tension spring 14, which is tensioned between the drive part 12 and the tongs body 2, is used to return the handles 3 and 11 to the original position (opened position). A tooth gap 15 which is on the drive part is used together with a locking hook 16, which is supported so as to rotate in a resiliently moving manner on the tongs body 2, in order to lock the handles 3 and 11 in the virtually pressed-together state.

Together with further components, the clamping jaws 4 and 8 form a stripping station for stripping the insulation of a conductor end, while there is another cutting station, for cutting through electrical leads, in the lower region of the tongs body 2. A blade 44, which is attached to the tongs body 2, and a counter-bearing 43 in the handle 11 form part of this cutting station, in order to hold a lead which is to be cut through.

A crimping station 17 is arranged in the part of the tongs body 2 located at the top and at the front. This crimping station has a crimping drum 18 which can rotate about a shaft 18*a* which is attached to the tongs body 2. A crimping lever 19 can pivot about a shaft A which is attached to the tongs body 2, the crimping lever 19 being provided with a crimping stamp 56. The free end of the crimping lever 19 engages via a pin 40 in a bent guide track 39 which is located inside the drive part 12. If the handles 3 and 11 are moved towards one another, then a controlled movement of the crimping lever also takes place and the crimping stamp 56 hence moves in the direction of the crimping drum 18.

Figure 2:
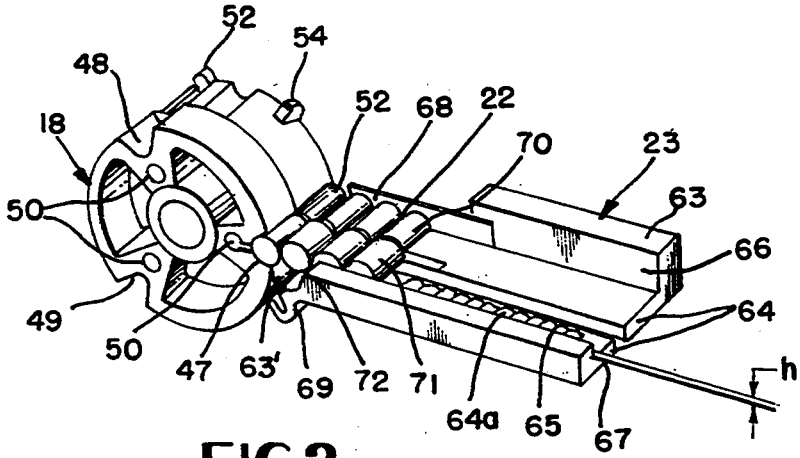
FIG. 2 shows the crimping station with the adjacent core end sleeve transportation station, in a perspective representation.

As can be seen in FIG. 2, this crimping drum 18 has a plurality of depressions 47, 48, 49 which are distributed uniformly around its circumference. These depressions are used for holding core end sleeves 22 which have different cross-sections. For example, core end sleeves for conductor cross-sections of 0.5 and 0.75 $mm^2$ can be positioned in the depression 47, while the depression 48 is suitable for holding core end sleeves for conductor cross-sections of 1.0 and 1.5 $mm^2$. The depression 49 would then be constructed for holding core end sleeves for conductor cross-sections of 2.5 $mm^2$.

In FIGS. 1 and 2, the depression 47 is located in a loading position in which a core end sleeve can thus be received from a supply and transportation station 23. If an already stripped conductor end is now inserted into the core end sleeve located in the depression 47, then in consequence the crimping drum 18 can be pressed to the rear in the axial direction, in that the conductor end acts on a locking lug 52 and takes the crimping drum 18 with it, via said lug. There are locking lugs 52 in each case at the end of a depression 47, 48 and 49. In the event of such an axial displacement of the crimping drum 18, said drum is coupled to a transportation lever which is not shown and, for its part, is connected to the drive part 12 via a pin which projects into an angled guide track. The crimping drum 18 is coupled to the transportation lever via projections 54 which run axially on the rear side of the crimping drum 18 and of which in each case one has a depression allocated to it.

If the crimping drum 18 is coupled to the drive part 12 via the transportation lever, then said drum is rotated in the clockwise direction when the handles 3 and 11 are pressed together. At the same time, the depression 47 is rotated out of the loading position into a crimping position. Once the depression 47 has reached the crimping position, then the crimping stamp 56 is guided into the crimping position when the handles 3 and 11 are pressed further together, so that the conductor end and core end sleeve are crimped to one another. When handles 3 and 11 are released, the crimping stamp 56 is initially moved from the crimping position, while the crimping drum 18 is subsequently rotated back in the opposite direction, so that the depression 47 moves out of the crimping position into the loading position again. During this entire rotation process of the crimping drum 18, said drum is locked in its axially displaced position, to be precise by the locking lugs 52 which engage behind suitable locking walls 53 which are arranged fixed to the housing (see FIG. 4).

Furthermore, in the undisplaced position, the crimping drum 18 can be rotated by hand, if it has not been loaded with a core end sleeve, so that a desired depression 47, 48 or 49 is moved into the loading position. This rotation position is locked via projections 50 which are present on its front side and are pressed into corresponding openings on the inner wall of the tongs body 2. For this purpose, a spring can be arranged between the rear side of the crimping drum 18 and the rear housing wall of the tongs body 2, by means of which spring the crimping drum 18 is also pushed forwards when the locking lugs 52 project behind the locking walls 53 again.

Figure 4:
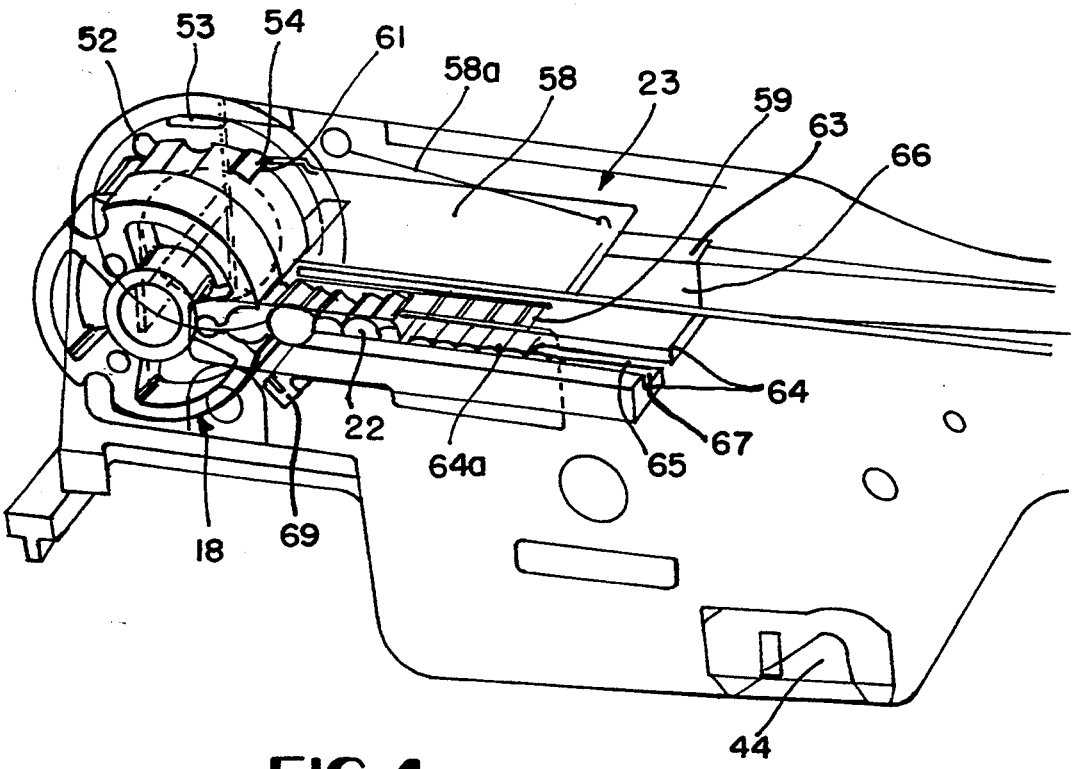
FIG. 4 shows a perspective representation of the crimping drum and core end sleeve transportation station with the transportation plate.

As can be seen in FIGS. 1 and 4, the supply and transportation station 23 for the core end sleeves 22 is arranged in the front region of the base 3*a* and adjacent to the crimping drum 18. This supply and transportation station 23 has a transportation station 58 (transportation device) for the step-by-step feeding of the core end sleeves 72. The transportation plate 58 is pretensioned in the direction of the crimping drum 18 with the aid of a spring 58*a*. On its underneath, the transportation plate 58 is provided with elastic lugs 59 which consist of metal or plastic and act on the core end sleeves 22. The transportation plate 58 is located essentially parallel to the base 3*a*, the lugs 59 pointing obliquely forwards in the direction of the crimping drum 18. As a result of parallel displacement of the transportation plate 58 away from the crimping drum 18 and back to the crimping drum 18, the core end sleeves 22 can thus be taken with it and at the same time displaced in the direction of the crimping drum 18. If the transportation plate 58 is moved away from the crimping drum, then the lugs 59 merely slide away over the core end sleeves, without displacing them. In contrast, during movement of the transportation plate 58 in the opposite direction, the entire core end sleeve belt is taken with it. The foremost core end sleeve is thus moved into a depression which is located in the loading position at this time. In this case, the crimping drum 18 has not yet been axially displaced. Elastic lugs 59*a* can likewise project from below through the base 3*a*, which lugs run obliquely with respect to the crimping drum 18 and are intended to prevent a movement of the core end sleeves 22 in the direction away from the crimping drum. These elastic lugs 59*a* are permanently positioned. Instead of these elastic lugs 59*a*, the base 3*a* may also have a row of teeth 64*a*, for example having three or more teeth (FIG. 4), which prevents simultaneous movement of the core end sleeves 22 when the crimping drum 18 moves. At the same time, the first tooth of the row of teeth 64*a*, which is adjacent to the crimping drum 18, can be larger or higher than the other teeth in order to obtain an initial position which is as defined as possible for the core end sleeves which are to be loaded.

FIG. 4 shows the construction of the transportation plate 58 in more detail. In particular, this transportation plate 58 has an inclined surface 61 on the front side. If the crimping drum 18 is displaced axially to the rear during insertion of a conductor end into a depression, then one of the projections 54 comes to rest above the inclined surface 61. During subsequent rotation of the crimping drum 18, a displacement of the transportation plate 58 away from the crimping drum 18 then takes place, since the projection 54 now acts on the inclined surface 61, and, by means of the latter, presses the transportation plate 58 away. The lugs 59 then slide elastically away over the core end sleeve belt which is located in the supply and transportation station 23, but tension it in the direction of the crimping drum because of its springing effect. When the crimping drum 18 is rotated in the clockwise direction, the core end sleeve in the depression is initially moved into the vicinity of a blade 63', which is arranged fixed to the housing, and is cut off by said blade from the rest of the core end sleeve belt before it reaches the crimping position. The blade is shown in FIG. 2. If the crimping drum 18 is rotated back into the initial position after completion of the crimping process, then the projection 54 initially releases the inclined surface 61. However, in this case, the transportation plate 58 has not yet moved back to the crimping station 18 since the depression has not yet reached the-loading position. Rather, the next core end sleeve initially comes to rest only on the circumference of the crimping drum 18. As soon as the depression has reached the loading position, the movement of the transportation plate 58 is released since the depression space is now available for the next core end sleeve. The spring 58*a* can .thus pull the transportation plate 58 in the direction of the crimping drum 18 and hence load the depression with the next core end sleeve. At the same time, the crimping drum 18 is in its forwards displaced position again, in which it is no longer engaged with the transportation lever.

Figure 5:
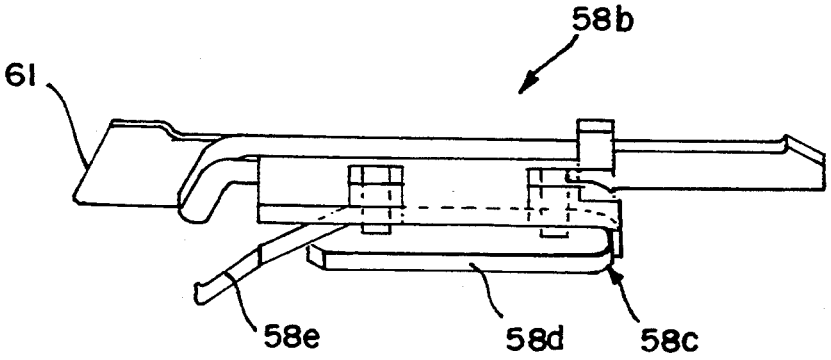
FIG. 5 shows a different configuration of the core end sleeve transportation station.

FIG. 5 shows a further embodiment of the supply and transportation device 23 in the region of its transportation plate 58*b*. Instead of the lugs or brushes, the transportation plate 58*b* here carries on its underneath an elastic spring element 58*c* which is produced, for example, from spring steel or plastic. The elastic spring element 58*c* has a horizontal arm 58*d* which comes to rest on the core end sleeve belt and presses the core end sleeves 22 against their bed 3*a* or 64. An arm 58*e*, which runs obliquely forwards from above or in the direction of the crimping drum 18, of the spring element 58*c* in contrast engages in the region between the core end sleeve 22 which is located next to the crimping drum 18 and the subsequent core end sleeve, in order to push the first-mentioned core end sleeve into the depression (in this case 47) which is located in the loading position when the spring element 58*c* with the transportation plate 58*b* is moved towards the crimping drum 18. The arm 58*e* is located in front of the horizontal arm 58*d*, seen in the feed direction. During movement of the transportation plate 58*b* in the opposite direction, the horizontal arm 58*d* slides away over the core end sleeves without taking them with it. The arm 58*e* and the horizontal arm 58*d* may also be present as separate elements and may be connected to the transportation plate 58*b*. By means of the teeth 64*a*, whose tooth-longitudinal direction runs parallel to the longitudinal direction of the core end sleeves, the core end sleeves are prevented from moving when the transportation plate 58*b* is removed from the crimping drum 18.

FIG. 2 shows the more detailed construction of a core end sleeve guide track of the supply and transportation device 23. The core end sleeve guide track has the reference number 63 and is constructed in a grooved shape. The groove itself has a rectangular cross-section and is formed by a base 64 and mutually opposite side walls 65 and 66. The base 64 can come to rest in the extension of the base 3*a*.

The core end sleeves 22 which are linked to one another in the form of a belt are transported in the longitudinal direction of the core end sleeve guide track 63 or in the groove direction, the individual core end sleeves 22 coming to rest with their longitudinal direction at right angles to the longitudinal direction of the core end sleeve guide track 63. The core end sleeves 22 are connected to one another in a suitable manner, as is still to be explained.

A guide groove 67, which is located in the side wall 65, is used for guiding the core end sleeves 22 inside the core end sleeve guide track 66. This guide groove 67 is obtained by extending the base 64 into the side wall 65 and has a groove height h at right angles to the base 64. The guide groove 67 extends over the entire length of the core end sleeve guide track, and parallel to it.

The other side wall 66 of the core end sleeve guide track 63 is provided in its front region with an elastic pressure element 68, which is pretensioned resiliently in the direction of the side wall 65. This elastic pressure element 68 may be, for example, a lug which is formed from spring steel and is connected to the side wall 66. The elastic pressure element 68 is used to press the core end sleeves 22 and the core end sleeve belt against the side wall 65 after the crimping drum 18 has been displaced to the rear in the axial direction and the core end sleeve belt has hence also been displaced in the front region of the core end sleeve guide track 63. The core end sleeves in the front region of the core end sleeve guide track then no longer rest entirely on the side wall 65 so that, after separation of the core end sleeve which is located in the depression 47 from the core end sleeve belt, a backward movement of the remaining core end sleeves 22 is necessary in the direction of the side wall 65. A new loading process takes place when the crimping drum 18 has been moved back into its axial original position again, after backwards rotation. The depression 47 and the next core end sleeve are now aligned with one another.

The base 64 is bent downwards in the front region of the core end sleeve guide track 63 and in the vicinity of the crimping drum 18 in order to form a projection 69 for holding the already-mentioned blade. Furthermore, FIG. 4 shows that the transportation plate 58 can be supported directly on the core end sleeve guide track 63 in the region of the side wall 66.

Figure 3:
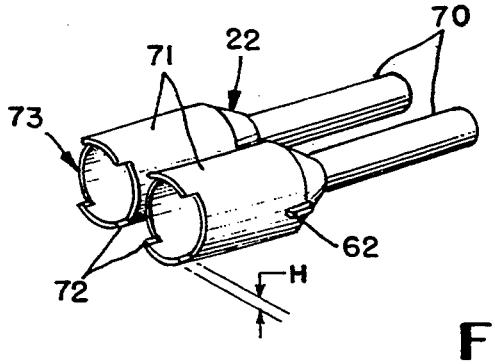
FIG. 3 shows two core end sleeves according to the invention which are linked to one another like a belt.

FIG. 3 shows the construction according to the invention of the core end sleeves for use in the core end sleeve guide track according to FIG. 2.

According to FIG. 3, each core end sleeve consists of a metal sleeve 70 which is located in the front region and of a plastic sleeve 71 which is located in the rear region, partially engages over the metal sleeve 70 and is permanently connected to the metal sleeve 70. The plastic sleeves 71 are connected to one another via plastic webs 62. These webs 62 are cut with the aid of the blade 63 during rotation of the crimping drum 18 and may be located at the front or rear in the longitudinal direction of the plastic sleeve 71.

Located on the rear end of the plastic sleeve 71, that is to say on the end of the plastic sleeve 71 facing away from the metal sleeve 70, there is preferably a projection. 72 which is integrally connected to the plastic sleeve 71. This projection 72 may be regarded as an extension, pointing to the rear, of the plastic sleeve 71 and, in other words, also has the external circumferential shape of the plastic sleeve 71. The projection 72 rests on an external belt surface related to the plane of the belt which is set by the core end sleeves 22. In other words, if the core end sleeves which are linked to one another in the form of a belt are located inside the core end sleeve guide track 63, then the projections 72 come to rest on the base 64 of the core end sleeve guide track 63. In this case, the projections 72 engage in the guide groove 67 and thus have a height H running at right angles to the plane of the belt and to the base 64, which height is matched to the groove height h. The height H of the projections 72 is in this case somewhat smaller than the groove height h, so that the projections 72 can be transported in the longitudinal direction of the guide groove 67 with only a small amount of play. In this case, the length of the core end sleeves 22 is selected such that the free tips of the metal sleeves 70 are guided through the side wall 66 located opposite the groove 67. Reliable transportation of the core end sleeves 22 in the longitudinal direction of the core end sleeve guide track 63 or in the groove direction is thus possible.

The projections 72 can be obtained, for example, by the plastic sleeves 71 in each case being provided with a perforating slot 73 which runs on its rear end and in the longitudinal direction of the belt. In this case, another projection is obtained which is opposite the projection 72 but which is not used for guide purposes.

Core end sleeves 22 for conductor cross-sections of different sizes can be guided with the aid of the core end sleeve guide track 63, for example core end sleeves for conductor cross-sections of 0.5/0.75 $mm^2$, for 1.0/1.5 $mm^2$ and 2.5 $mm^2$. Thus, although the core end sleeves have different diameters for different conductor cross-sections, the projections 72 on the rear end of their plastic sleeves 71 are always provided with the same height H, so that all the projections can be guided in the side wall 65 with the aid of the guide groove 67 in every case, irrespective of the conductor cross-section provided for the core end sleeves. The core end sleeves 22 for the various conductor cross sections, preferably have the same axial length, so that the side wall 66, which is opposite the groove 67, of the core end sleeve guide track 63 can also be used for guiding the core end sleeves. Apart from the projection, the length of the core end sleeves 22 now corresponds to the distance of the side wall 65 and 66 from one another, irrespective of the conductor cross-section provided for said sleeves.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. Core end sleeves comprising core end sleeves linked to one another in the form of a belt, each core end sleeve having a metal sleeve in a front region thereof and a plastic sleeve which partially engages over the metal sleeve and is permanently connected to the metal sleeve, the plastic sleeve being in a rear region of the core end sleeve, the core end sleeves being connected to one another via the plastic sleeves, each of the plastic sleeves being provided on their rear end with a projection which points rearwardly and forms an outer side of the belt, each of the plastic sleeves having a perforating slot which runs on the rear thereof in the longitudinal direction of the belt in order to form the projection.

2. The core end sleeves which are linked to one another in the form of a belt according to claim 1, wherein a height (H), running generally at right angles to a plane of the belt, of the projection is independent of a diameter of the plastic sleeves.

3. The combination of core end sleeves and a device for transportation of the core end sleeves comprising the core end sleeves being linked to one another in the form of a belt, each core end sleeve having a metal sleeve in a front region thereof and a plastic sleeve which partially engages over the metal sleeve and is permanently connected to the metal sleeve, the plastic sleeve being in a rear region of the core end sleeve, the core end sleeves being connected to one another via the plastic sleeves, each of the plastic sleeves being provided on their rear end with a projection which points rearwardly and forms an outer side of the belt, each of the plastic sleeves having a perforating slot which runs on the rear thereof in the longitudinal direction of the belt in order to form the projection, the device having a groove-shaped core end sleeve guide track with a base and mutually opposite side walls, one of the side walls having a guide groove which is incorporated in an extension of the base and is used to hold the projections of the core end sleeves in a fitting manner during their transportation along the guide track.

4. The combinations according to claim 3, wherein the base is provided on the end of the guide track with a row of teeth which prevents the core end sleeve belt from sliding backwards when the transportation device is pushed back.

5. The combination according to claim 3, wherein the device further comprises an elastic pressure element, which is pretensioned in the direction of the guide groove, at least in the end region of the side wall which is opposite the guide groove.

6. The combination according to claim 3, wherein the device further comprises a transportation device which is reciprocally movable and is supported above the guide track for step-by-step feeding of the core end sleeves.

7. The combination according to claim 6, wherein the transportation device further comprises a plurality of elastic lugs supported below the transportation device, the lugs lie generally parallel to one another and point obliquely downwards in a feed direction.

8. The combination according to claim 6, wherein the transportation device further comprises an elastic bracket supported on an underside thereof, the bracket has a rear horizontal arm and an arm which is located at the front in a feed direction and projects obliquely downwards in the feed direction.

9. The combination according to claim 8, wherein the elastic bracket comprises a spring steel.

10. The combination according to claim 3, wherein the core end sleeves have a height (H), running generally at right angles to a plane of the belt, of the projection which is independent of a diameter of the plastic sleeves.

11. The combination according to claim 3, wherein at the end of the guide track in the region of the base, a blade is provided for separating the plastic sleeves from one another.

* * * * *